US008714730B2

(12) United States Patent
Gordon et al.

(10) Patent No.: US 8,714,730 B2
(45) Date of Patent: May 6, 2014

(54) METHOD OF SELECTIVE DRUM MAINTENANCE IN A DRUM MAINTENANCE UNIT IN A PRINTING APPARATUS

(75) Inventors: Michael Cameron Gordon, West Linn, OR (US); Joseph B. Gault, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 175 days.

(21) Appl. No.: 13/324,523

(22) Filed: Dec. 13, 2011

(65) Prior Publication Data

US 2013/0147888 A1 Jun. 13, 2013

(51) Int. Cl.
*B41J 2/01* (2006.01)

(52) U.S. Cl.
USPC ..... 347/103; 347/88; 347/99

(58) Field of Classification Search
USPC ..... 347/9, 14, 88, 99, 101, 103; 101/216, 101/217, 484, 489, 492; 399/237; 400/582
IPC ..... B41J 2/01
See application file for complete search history.

(56) References Cited

U.S. PATENT DOCUMENTS 6,068,372 A 5/2000 Rousseau et al.
6,176,575 B1 1/2001 Crawford et al.
6,755,519 B2 6/2004 Gelbart et al.
7,036,920 B2 5/2006 Rousseau et al.
7,677,717 B2 3/2010 Islam et al.
7,931,363 B2 4/2011 Burress et al.
2005/0111861 A1* 5/2005 Calamita et al. ..... 399/66
2005/0134666 A1 6/2005 Rousseau
2006/0250467 A1* 11/2006 Folkins ..... 347/103
2007/0139496 A1 6/2007 Leighton et al.
2007/0146459 A1 6/2007 Gault et al.
2007/0146460 A1 6/2007 Gordon et al.
2007/0146461 A1 6/2007 Islam et al.
2010/0231674 A1 9/2010 Domoto et al.
2010/0245447 A1* 9/2010 Kohne et al. ..... 347/16
2010/0271450 A1* 10/2010 Burress et al. ..... 347/103
2010/0271451 A1* 10/2010 Burress et al. ..... 347/103

* cited by examiner

*Primary Examiner* — Manish S Shah
*Assistant Examiner* — Roger W Pisha, II
(74) *Attorney, Agent, or Firm* — Maginot, Moore & Beck, LLP

(57) ABSTRACT

A printing process identifies conditions for operating an image receiving member to transfer a plurality of ink images from the image receiving member to a plurality of media sheets between applications of release agent to the image receiving member. The printing process transfers a first ink image from the image receiving member to a first media sheet, identifies a size of a second ink image, and forms the second ink image entirely within a portion of the surface of the image receiving member that carried the first ink image. The printing process enables printing with acceptable quality while reducing the consumption of release agent and wear on components in the printer.

20 Claims, 4 Drawing Sheets

METHOD OF SELECTIVE DRUM MAINTENANCE IN A DRUM MAINTENANCE UNIT IN A PRINTING APPARATUS

TECHNICAL FIELD

The method described below relates to phase change inkjet printers, and more particularly to release agent application systems used in these printers.

BACKGROUND

Phase change inkjet printers receive phase change ink as a solid, which may be in the form of solid blocks or ink sticks, pellets, or pastilles. The solid ink is loaded into a printer and then melted to produce liquid ink that is used to form images on print media. Phase change inkjet printers form images using either a direct or an offset (sometimes called indirect) print process. In a direct print process, melted ink is jetted directly onto print media to form images. In an offset print process, also referred to as an indirect print process, melted ink is jetted onto a surface of a rotating member, such as the surface of a rotating drum, belt, or band. Print media are moved proximate the surface of the rotating member in synchronization with the ink images formed on the surface. The print media are then pressed against the surface of the rotating member as the media passes through a nip formed between the rotating member and a transfix roller. The ink images are transferred and affixed to the print media by the pressure in the nip.

Offset phase change inkjet printers utilize drum maintenance units (DMUs) to facilitate the transfer of ink images to the print media. A DMU is usually equipped with a reservoir that contains a fixed supply of release agent (e.g., silicone oil), and an applicator for delivering the release agent from the reservoir to the surface of the rotating member. One or more elastomeric metering blades are also used to meter the release agent onto the transfer surface at a desired thickness and to divert excess release agent and un-transferred ink pixels to a reclaim area of the drum maintenance system. The collected release agent is filtered and returned to the reservoir for reuse.

A small amount of release agent is removed from the system with each print. The control system of the printer utilizes a life-sensing process to predict when the supply of release agent is likely to be depleted so an alert can be generated indicating that the DMU is in need of replacement before the supply is exhausted. Volume sensors are impractical so previously known life-sensing processes involve various combinations of open loop print counting and predictions of oil mass remaining in the source following detection of a float sensor reaching a predetermined level in the source. An end-of-life condition is sensed in response to air being detected in the oil intake from the source.

During transfer of the ink images from the image receiving member to the media sheets, each of the media sheets extracts a small quantity of release agent from the surface of the image receiving member. The ink pixels that are placed on the oiled and metered imaging surface typically remove more oil from the imaging surface during transfer than the non-inked media does. This difference in oil removal produces a differential oil "ghost" of the image that resides on the image receiving member until the next drum maintenance cycle. This oil "ghost" is erased by the subsequent flooding of oil on the imaging member by the oil applicator and the metering of the release agent layer by the elastomeric blade. Additionally, since some ink drops in an ink image often fail to transfer to the media sheets, the image receiving member carries some residual ink drops that can transfer to a subsequent media sheet resulting in a "freckling" effect on the subsequent media sheet. To reduce or prevent ghosting and freckling, the DMU applies a new coating of release agent to the image receiving member after each image formation and transfer operation from the image receiving member. The metering blade removes residual ink drops from the image receiving member and forms a layer of release agent with uniform thickness on the image receiving member. Frequent use of the DMU reduces the operational life of the DMU, but is necessary in existing printers to avoid excessive ghosting and freckling. Thus, improvements to printers that lengthen the life of the DMU while maintaining acceptable image quality during printing are desirable.

SUMMARY

In one embodiment, a method of operating a printer has been developed that enables a longer operational life of a drum maintenance unit in a printer. The method includes transferring a first ink image formed on a layer of release agent on a surface of an image receiving member to a first media sheet and leaving a portion of the layer of release agent on the surface of the image receiving member, forming a second ink image on the surface of the image receiving member prior to forming another layer of release agent on the image receiving member, the second image being formed entirely on the portion of the layer of release agent on the image receiving member left after the transfer of the first ink image, and transferring the second ink image from the image receiving member to a second media sheet.

In another embodiment, a printer that is operated in accordance with the method described above has been developed. The printer includes an image receiving member configured to carry at least one ink image, a maintenance unit configured to apply a layer of a release agent to a surface of the image receiving member, at least one printhead configured to eject ink drops onto the layer of release agent on the surface of the image receiving member to form the at least one ink image, a media transport configured to engage a media sheet to the image receiving member to transfer an ink image from the image receiving member to the print medium, and a controller operatively connected to the image receiving member, maintenance unit, at least one printhead, and media transport, the controller being further configured to: apply a first layer of the release agent on the surface of the image receiving member with the maintenance unit, form a first ink image on the layer of release agent on the image receiving member with the at least one printhead, move a first media sheet into engagement with the first ink image on the layer of release agent on the image receiving member with the media transport to transfer the first ink image to the first media sheet, form a second ink image on the image receiving member with the at least one printhead prior to applying another layer of release agent on the surface of image receiving member, the second ink image being formed entirely on the layer of release agent remaining on the image receiving member after the first ink image is transferred to the first media sheet, and move a second media sheet into engagement with the second ink image on the layer of release agent on the image receiving member with the media transport to transfer the second ink image to the second media sheet.

DETAILED DESCRIPTION

Figure 1:
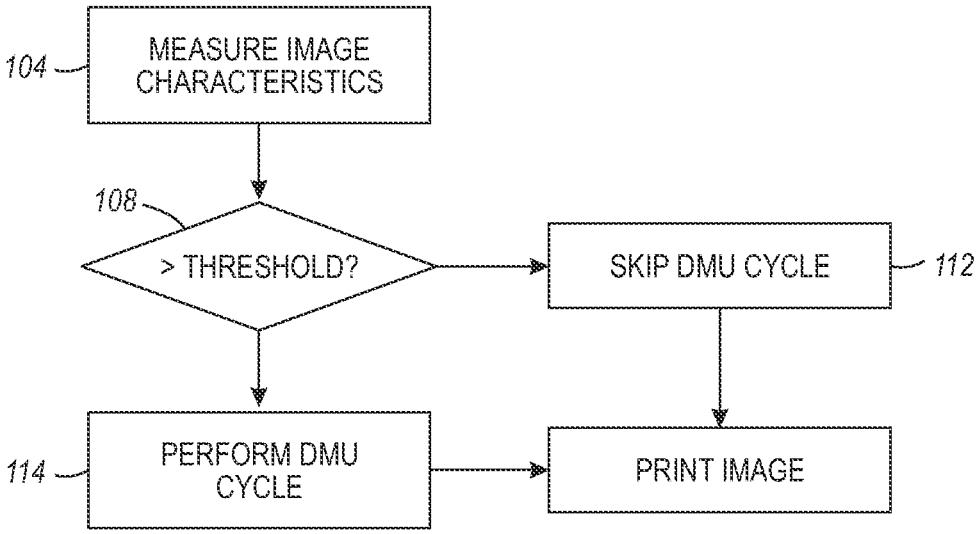
FIG. 1 is a flow diagram of a process that measures image characteristics of images to be printed and compares them to predetermined thresholds to determine whether to perform or skip a DMU cycle.

The description below and the accompanying figures provide a general understanding of the environment for the method disclosed herein as well as the details for the method. In the drawings, like reference numerals are used throughout to designate like elements. The word "printer" as used herein encompasses any apparatus that generates an image on media with ink. The word "printer" includes, but is not limited to, a digital copier, a bookmaking machine, a facsimile machine, a multi-function machine, or the like. The terms "simplex" and "duplex" used in reference to the term "prints" describe whether an ink image is formed on one side of the sheet, i.e., "simplex print," or both sides of the print, i.e., "duplex print." The description below is directed to a system that identifies specific image characteristics that impact the risk of particular image failures, then uses those specific image characteristics to determine whether a DMU cycle can be skipped. Appropriately skipping DMU cycles aids in extending the operational life of the cleaning unit and, in some cases, the life of the entire printer.

A process for determining whether a DMU cycle can be skipped is shown in FIG. 1. The process begins with measurement of the specific image characteristics (block 104) that impact the risk of particular image failures. The term "image characteristics" is described in more detail below. The image characteristic measurements can be determined at certain times relative to operation based on sophistication or configuration of the printing device. For example, image characteristic measurements can be determined with reference to image content that can be determined prior to actual imaging. In one embodiment, analysis of an image is performed while the print engine is "ripping" the image to determine concurrently with the image processing such characteristics as the number of pixels in an image.

With continued reference to FIG. 1, the image characteristic measurements are compared to predetermined characteristic thresholds or conditions (block 108). The predetermined thresholds or conditions are related to low risk scenarios for image defects and failures. Therefore, if the image characteristic measurements meet the predetermined thresholds or conditions, a DMU cycle is skipped (block 112). If the image characteristic measurements do not meet the predetermined thresholds or conditions, then the DMU cycle is performed (block 114).

When determining image characteristics, the printer is operated with reference to the image characteristics of one or more print images used to generate ink images. These print images may be denoted as a current print image, a previous print image, or a next print image. As used herein, the terms "print image" and "current print image" refer to the image being processed for production of an ink image. The term "next print image" refers to an image that may have been at least partially processed by the controller, but not yet used to generate firing signals for the printheads in the printer. Next print image may also be understood as "no subsequent print job," if no immediate print job follows the current image. The term "previous print image" refers to a print that has already been used to produce an ink image, and a measurement of its image characteristics are retained in a form that enables the measurement to be used to alter the print process of the current print image. In the context of a duplex print image, the current print image can be the first side printed and the next print image can be the second side printed. Production of an ink image refers to the process in which the printer makes a print by, for example, applying release agent to an image receiving member and operating one or more printheads with reference to print image data to eject ink onto the image receiving member.

As used in this document, "measuring image characteristics" of a print image refers to a process in which the characteristics of a print job are determined and placed in a format that can be utilized in logical decisions and analysis for operation of the imaging device. Examples of a measurement, which may be referred to as a score, include, but are not limited to, counting, tallying, finding a maximum, finding a minimum, calculating (such as a percentage), converting to an integer scale, or the like. Examples of characteristics include, but are not limited to, the total number of pixels in an area of an ink image, the number of pixels within specified areas of an ink image, the relationship between the ink on the image receiving member and the media or other printer components, the quantity or occurrence of pixel patterns in an ink image, the colors present in an ink image, or the like.

The logical decisions and analysis performed with reference to the characteristics can be the same or different based on whether the image is a current print image, a next print image, or a previous print image. For example, comparison of an image characteristic measurement to a predetermined threshold can use the same or different thresholds for current print images, next print images, or previous print images. Additionally or alternatively, other criteria, such as duty cycle or a thermal state, can be used to govern a logical decision or analysis. Also, comparisons described in this document are frequently described as exceeding a threshold. This description is meant to encompass the value being greater than the threshold or less than the threshold depending on the context of the comparison. Thus, exceeding a threshold can refer to a value greater than a maximum in one context and referring to a value less than a minimum in another context.

Figure 3:
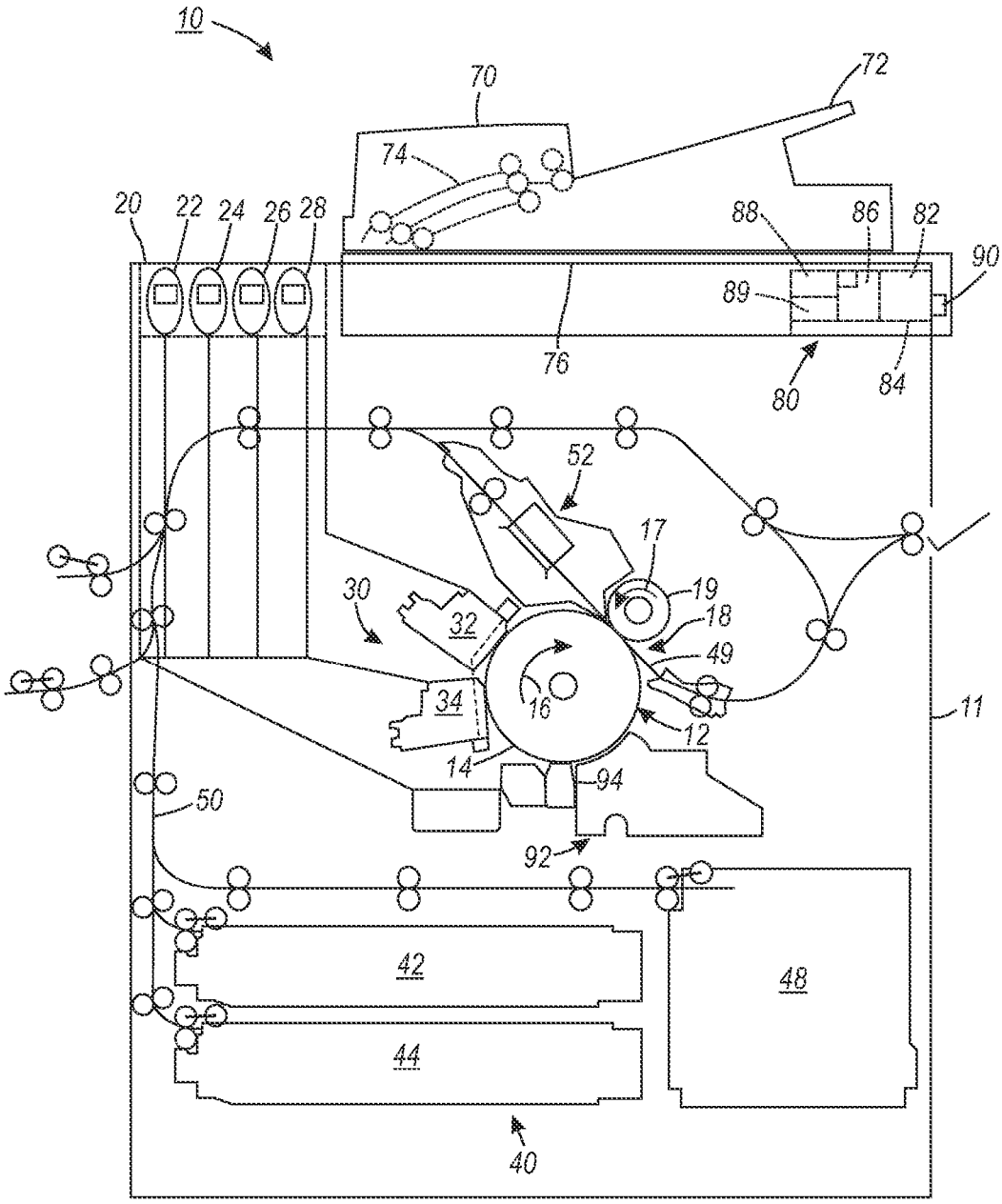
FIG. 3 is a schematic, side elevation view of an ink jet printer that implements the processes shown in FIGS. 1 and 2A and 2B.

Referring now to FIG. 3, an embodiment of a printer, such as a high-speed phase change ink printer 10, is depicted. As illustrated, the printer 10 includes a frame 11 to which are mounted directly or indirectly all its operating subsystems and components, as described below. To start, the high-speed phase change ink image producing machine or printer 10 includes an image receiving member 12 that is shown in the form of a drum, but can equally be in the form of a supported endless belt. The image receiving member 12 has an imaging surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a heated media sheet 49.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Each printhead assembly 32 includes at least one printhead configured to eject ink drops onto the surface 14 of the image receiving member 12 to produce an ink image thereon. Since the phase change ink printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies can be one or any number greater than two.

As further shown, the phase change ink printer 10 includes a substrate supply and handling system 40, also known as a media transport. The substrate supply and handling system 40, for example, can include sheet or substrate supply sources 42, 44, 48, of which supply source 48, for example, is a high capacity paper supply or feeder for storing and supplying image receiving substrates in the form of cut media sheets 49, for example. The substrate supply and handling system 40 also includes a substrate handling and treatment system 50 that has a substrate heater or pre-heater assembly 52. The phase change ink printer 10 as shown can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead assemblies 32, 34 (and thus the printheads), and the substrate supply and handling system 40. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the processes, described more fully below, that enable the printer to perform the DMU cycles selectively. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. Additionally, pixel placement control is exercised relative to the imaging surface 14 thus forming desired images per such image data, and receiving substrates, which may be in the form of media sheets 49, are supplied by any one of the sources 42, 44, 48 and handled by substrate system 50 in timed registration with image formation on the surface 14. Finally, the image is transferred from the surface 14 and fixedly fused to the image substrate within the transfix nip 18.

In some printing operations, a single ink image can cover the entire surface of the imaging member 12 (single pitch) or a plurality of ink images can be deposited on the imaging member 12 (multi-pitch). Furthermore, the ink images can be deposited in a single pass (single pass method), or the images can be deposited in a plurality of passes (multi-pass method). When images are deposited on the image receiving member 12 according to the multi-pass method, under control of the controller 80, a portion of the image is deposited by the printheads within the printhead assemblies 32, 34 during a first rotation of the image receiving member 12. Then during one or more subsequent rotations of the image receiving member 12, under control of the controller 80, the printheads deposit the remaining portions of the image above or adjacent to the first portion printed. Thus, the complete image is printed one portion at a time above or adjacent to each other during each rotation of the image receiving member 12. For example, one type of a multi-pass printing architecture is used to accumulate images from multiple color separations. On each rotation of the image receiving member 12, ink droplets for one of the color separations are ejected from the printheads and deposited on the surface of the image receiving member 12 until the last color separation is deposited to complete the image. In some cases, for example those using secondary or tertiary colors, one ink droplet or pixel can be placed on top of another one, as in a stack. Another type of multi-pass printing architecture is used to accumulate images from multiple swaths of ink droplets ejected from the print heads. On each rotation of the image receiving member 12, ink droplets for one of the swaths (each containing a combination of all of the colors) are applied to the surface of the image receiving member 12 until the last swath is applied to complete the ink image. Both of these examples of multi-pass architectures perform what is commonly known as "page printing." Each image comprised of the various component images represents a full sheet of information worth of ink droplets which, as described below, is then transferred from the image receiving member 12 to a recording medium.

In a multi-pitch printing architecture, the surface of the image receiving member is partitioned into multiple segments, each segment including a full page image (i.e., a single pitch) and an inter-document zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image or images have been printed on the image receiving member 12 under control of the controller 80 in accordance with an imaging method, such as the single pass method or the multi-pass method, the exemplary ink jet printer 10 converts to a process for transferring and fixing the image or images at the transfix roller 19 from the image receiving member 12 onto a recording medium 49. According to this process, a sheet of recording medium 49 is transported by a transport under control of the controller 80 to a position adjacent the transfix roller 19 and then through a nip formed between the movable or positionable transfix roller 19 and image receiving member 12. The transfix roller 19 applies pressure against the back side of the recording medium 49 in order to press the front side of the recording medium 49 against the image receiving member 12. Although the transfix roller 19 can also be heated, in this exemplary embodiment, it is not. Instead, a pre-heater for the recording medium 49 is provided in the media path leading to the nip. The pre-heater provides the necessary heat to the recording medium 49 for subsequent aid in transfixing the image thereto, thus simplifying the design of the transfix roller. The pressure produced by the transfix roller 19 on the back side of the heated recording medium 49 facilitates the transfixing (transfer and fusing) of the image from the image receiving member 12 onto the recording medium 49.

The rotation or rolling of both the image receiving member 12 and transfix roller 19 not only transfixes the images onto the recording medium 49, but also assists in transporting the recording medium 49 through the nip formed between them. Once an image is transferred from the image receiving member 12 and transfixed to a recording medium 49, the transfix roller 19 is moved away from the image receiving member 12 and the image receiving member 12 continues to rotate and, under the control of the controller 80, any residual ink left on the image receiving member 12 is removed by well known drum maintenance procedures performed at a drum maintenance unit (DMU) 92.

The DMU 92 includes a release agent applicator 94, a metering blade and, in some embodiments, a cleaning blade. The release agent applicator 94 further includes a reservoir having a fixed volume of release agent such as, for example, silicone oil, and a resilient donor roll, which may be smooth or porous and is rotatably mounted in the reservoir for contact with the release agent and the metering blade. The metering blade is compliant such that it can firmly and uniformly contact the image receiving member. The cleaning blade is also compliant such that it can firmly and uniformly contact the image transfer surface. The DMU 92 is operably connected to the controller 80 such that the donor roll, metering blade and cleaning blade are selectively moved by the controller 80 into temporary contact with the rotating image receiving member 12 to deposit and distribute release agent onto and remove un-transferred ink pixels from the surface of the member 12.

The primary function of the release agent is to prevent the ink from remaining adhered to the image receiving member 12 during transfixing when the ink is being transferred to the recording medium 49. Release agent also aids in the protection of the transfix roller 19. Small amounts of the release agent are transferred to the transfix roller 19 and this small amount of release agent helps prevent ink from adhering to the transfix roller 19. Consequently, a minimal amount of release agent on the transfix roller 19 is desirable. In the systems described herein, the transfix roller 19 does not have a release agent application system, but instead obtains release agent from the front side of a duplex print or from intentional contact with the image receiving member 12. The amount of release agent delivered by the front side of a duplex print depends upon the amount of ink on that side because ink typically carries more release agent than bare media as described in more detail below. Additionally, rotational contact of the transfix roller 19 and image receiving member 12 can be used to apply a desired release agent film to the transfix roller 19. Intentional contact between the transfix roller 19 and the image receiving member 12 can be achieved by actuating the transfix roller 19 and timing the contact period as part of the normal print process, when desired as part of a special process, or at specified operation states or intervals, such as every fifty prints, as part of a printer's power-on and/or power-off sequence, or the like. Alternatively, the transfix roller 19 can have its own release agent application system.

Incorrect application and distribution of release agent, however, presents issues with release agent consumption and with image quality defects. Excessive release agent consumption causes a shorter operational life for the DMU 92. In printers having a DMU 92 and release agent supply that are intended to last for the lifetime of the printer, excessive release agent consumption causes a shorter operational life of the entire printer. Additionally, a number of different image quality defects may be caused by incorrect application and distribution of release agent on the image receiving member and the print media.

To combat these issues with incorrect application and distribution of release agent on the image receiving member and the print media, the controller 80 periodically operates the DMU 92 to perform a DMU cycle. A DMU cycle includes multiple functions including applying a uniform layer of release agent, cleaning un-transferred pixels from the previous image off of the image transfer surface and eliminating differential glosses in the amount of release agent remaining on the image member following the printing of an image.

The surface of the image receiving member 12 has a tightly controlled surface that provides a microscopic reservoir capacity to hold the release agent. Too little release agent present in areas or over the entire image receiving member prevents transfer of the ink pixels to the print media 49. This image defect is referred to herein as "image dropout" when it occurs over particular areas or pixels of the ink image and "cohesive image transfer failure" when it occurs over the entirety of the ink image. Conversely, too much release agent present on the image receiving member 12 results in transfer of some release agent to the back side of the print media 49. If the print media 49 is then printed on both sides in duplex printing, the ink pixels may not adhere properly to the second side of the print media 49. To combat these image defects, each DMU cycle selectively applies and meters release agent onto the surface of the image receiving member 12 by bringing the donor roller and then the metering blade of the release agent applicator 94 into contact with the surface of the image receiving member 12 prior to subsequent printing of images on the image receiving member 12 by the printheads in assemblies 32, 34. These actions replenish the release agent to the reservoir on the surface of the image receiving member 12 to prevent image failure and ensure continued application of a uniform layer of release agent to the surface of the image receiving member 12.

To clean un-transferred pixels or image dropouts from the previous image off the image receiving member surface 14, the controller 80 brings the metering and/or cleaning blade into contact with the image receiving member 12 following the printing of an image. If these dropout pixels are not removed by the DMU 92 they are typically transfixed onto the next image that is printed. These pixels can produce image defects, especially when the stray pixel is transfixed onto a field of high coverage yellow or white space. This defect, an image dropout that was not collected by the DMU 92, is referred to herein as "freckling."

As images are printed, the print media 49 and the ink remove release agent from the surface of the image receiving member 12, but typically in uneven amounts over the surface of the image receiving member 12. The evenness of the amount of release agent removed from the surface of the image receiving member 12 depends on, among other factors, the smoothness of the print media 49 and the density of the pixel placement in the print image. After an image is transfixed, the surface of the image receiving member 12 may be left with a pattern of differential release agent placement that is the inverse of the release agent removed by the ink pixels and print media 49 of the previous image. If left uncorrected, the residual release agent may appear within inked regions of the next media sheet 49. This defect is referred to herein as "ghosting." To prevent ghosting, the DMU cycle corrects the amount of release agent applied over the image receiving member 12 to reduce differentials in the amount of release agent remaining on the image receiving member following the printing of an image.

To decrease occurrences of the above image defects, the controller typically operates the DMU to perform a DMU cycle prior to every printed image. Performing the DMU cycle takes time, resulting in slower overall process times for the printer 10, and depletes the amount of release agent present in the release agent reservoir, resulting in higher costs for printer operation. Therefore, skipping unnecessary performances of the DMU cycle would be advantageous; resulting in less consumption of release agent, greater longevity of the metering blade, greater longevity of the cleaning blade, and greater longevity of the drive mechanism.

Some image characteristics and thresholds are related to lower risk scenarios for the image defects described above. Identifying these image characteristics and thresholds thus enables determination of when DMU cycles can be skipped with low risk of the above-described image defects. To achieve the advantages of skipping DMU cycles while maintaining image quality integrity, the process shown in FIG. 1 has been developed to measure image characteristics, compare the image characteristics to predetermined conditions and thresholds, determine the risk of image defects and either perform or skip a DMU cycle, accordingly.

One image characteristic that impacts the risk of image defects is the number of isolated pixels in a previous image. Used herein, the term "isolated pixels" refers to an ink drop on the image receiving member 12 that is not abutting other ink drops. An isolated pixel has a higher chance of being dropped out, or left on the image receiving member 12 when the image is transferred to the print media 49. Thus, an image printed following an image with more isolated pixels is more likely to have freckling defects. Likewise, an image printed following an image with fewer isolated pixels is less likely to have freckling defects. Accordingly, the controller 80 is configured to identify a number of isolated pixels or ink drops in a previous image, and then compare this number to a predetermined threshold number of isolated pixels or ink drops to determine the level of risk of freckling on the current image to determine whether to perform (high risk) or skip (low risk) a DMU cycle.

Another image characteristic that impacts the risk of image defects is the amount of dark solid fill on the current image. Used herein, the term "dark solid fill" refers to an area of the image that has a high percentage of coverage with dark ink colors or with a combination of ink colors that results in the appearance of a dark color. The amount of dark solid fill is positively correlated with the total coverage on the media sheet 49. A non-uniform distribution of release agent over the image receiving member 12, leading to a non-uniform transfer of ink to the print media 49, is more apparent on the current image when the current image has large amounts of dark solid fill. A current image having a greater amount of dark solid fill has a greater risk of exhibiting ghosting defects. Likewise, a current image having a lesser amount of dark solid fill has a lower risk of exhibiting ghosting defects. Accordingly, the controller 80 is configured to identify a percentage of dark solid fill in a current image, and then compare this percentage to a predetermined threshold percentage of dark solid fill to determine the level of risk of ghosting on the current image to determine whether to perform (high risk) or skip (low risk) a DMU cycle.

Another image characteristic that may impact the risk of image defects is the size and orientation of the image area onto which the ink images are transferred to the print media 49. If ink images are successively printed on different sizes or orientations of image area, then the area from which the release agent on the image receiving member 12 is absorbed by the print media 49 within the image area differs from one image to the next. If the print media to receive the current image can be placed entirely within or entirely outside the image area of the previous image, the amount and distribution of release agent on the image receiving member 12 for the current image is not impacted by the previous image. In this case, the risk of image defects for the current image is lower and the DMU cycle can be skipped. However, if the print media to receive the current image is sized or oriented such that it cannot be placed entirely within or entirely outside the image area of the previous image, the amount and distribution of release agent on the image receiving member 12 for the current image is impacted by the previous image. In this case, the risk of image defects for the current image is higher and the DMU cycle should be performed. Accordingly, the controller 80 is configured to identify the sizes and orientations of print media for previous images, current images and next images to receive ink images from the image receiving member 12 and compare these sizes and orientations to predetermined conditions or scenarios in which the print media can be placed entirely within or entirely outside the image area of the previous image (low risk of image defects) or cannot be placed entirely within or entirely outside the image area of the previous image (high risk of image defects). The controller 80 then determines whether the DMU cycle should be skipped (low risk) or performed (high risk).

Additionally, the controller 80 is configured to identify a proportion of the layer of release agent on the image receiving member that is covered by ink from the previous image and compare this proportion to a predetermined threshold proportion. If the proportion is less than the predetermined threshold proportion, the controller skips a DMU cycle. If the proportion is greater than the predetermined threshold proportion, the controller performs a DMU cycle. The controller 80 is also configured to identify a second proportion of the layer of release agent on the image receiving member that was covered by ink from the previous image that will also be covered by ink from the current image. The controller is configured to then compare this second proportion with a second predetermined threshold proportion. If the second proportion is less than the second predetermined threshold proportion, the controller skips a DMU cycle. If the second proportion is greater than the second predetermined threshold proportion, the controller performs a DMU cycle.

Another factor that may impact the risk of image defects is the amount of time that has elapsed since the last DMU cycle was performed. Because a DMU cycle is performed prior to printing an ink image, this characteristic can also be identified as the amount of time that has elapsed since the previous ink image was printed. If a significant amount of time has elapsed, dust may have settled on the image receiving member 12 and the layer of release agent may need to be refreshed.

Accordingly, the controller 80 is configured to identify a time when the previous DMU cycle is performed, a time when the previous image was printed, a time when the current DMU cycle may be performed and a time when the current image is to be printed. The controller is also configured to identify amounts of elapsed time between these identified times, and is configured to compare these amounts of elapsed time to predetermined threshold amounts of elapsed time to determine the whether another DMU cycle should be performed (the elapsed time is greater than the threshold) or skipped (the elapsed time is less than the threshold). The threshold for elapsed time between the time that the previous image was printed and the time that the current image is to be printed may be, for example, thirty minutes or an hour.

Another factor that may impact the risk of image defects is the overall number of DMU cycles that have been performed. New metering blades may not be as effective at ensuring that the correct amount and distribution of release agent is spread over the image receiving member. Thus, the risk of image defects is higher for new metering blades, or metering blades that have not performed a minimum number of DMU cycles. Accordingly, the controller 80 is configured to identify a total number of DMU cycles that have been performed using the particular metering blade. The total number of DMU cycles that have been performed corresponds to a number of times that the metering blade has engaged the image receiving member, and this number of times is then compared to a predetermined threshold number of DMU cycles (or a predetermined threshold number of times that the metering blade has engaged the image receiving member) to determine whether the number is less than the predetermined threshold number (higher risk of image defects) or greater than the threshold number (lower risk of image defects). The controller 80 then determines whether a DMU cycle should be performed (higher risk) or skipped (lower risk).

While these image characteristics help determine whether to perform or skip a DMU cycle, other image data corresponding to other image characteristics can be evaluated as well. For example, the print resolution can be factored into the determination of whether to perform or skip a DMU cycle. An ink image printed with lower print resolution prints a lower density of pixels. An ink image printed with lower print resolution that has lower total coverage on the media sheet has a higher probability of printing an image with isolated pixels and, thus, a higher risk of freckling defects. The controller 80 could be configured to factor these print characteristics into the determination of whether to perform or skip a DMU cycle.

Figure 2A:
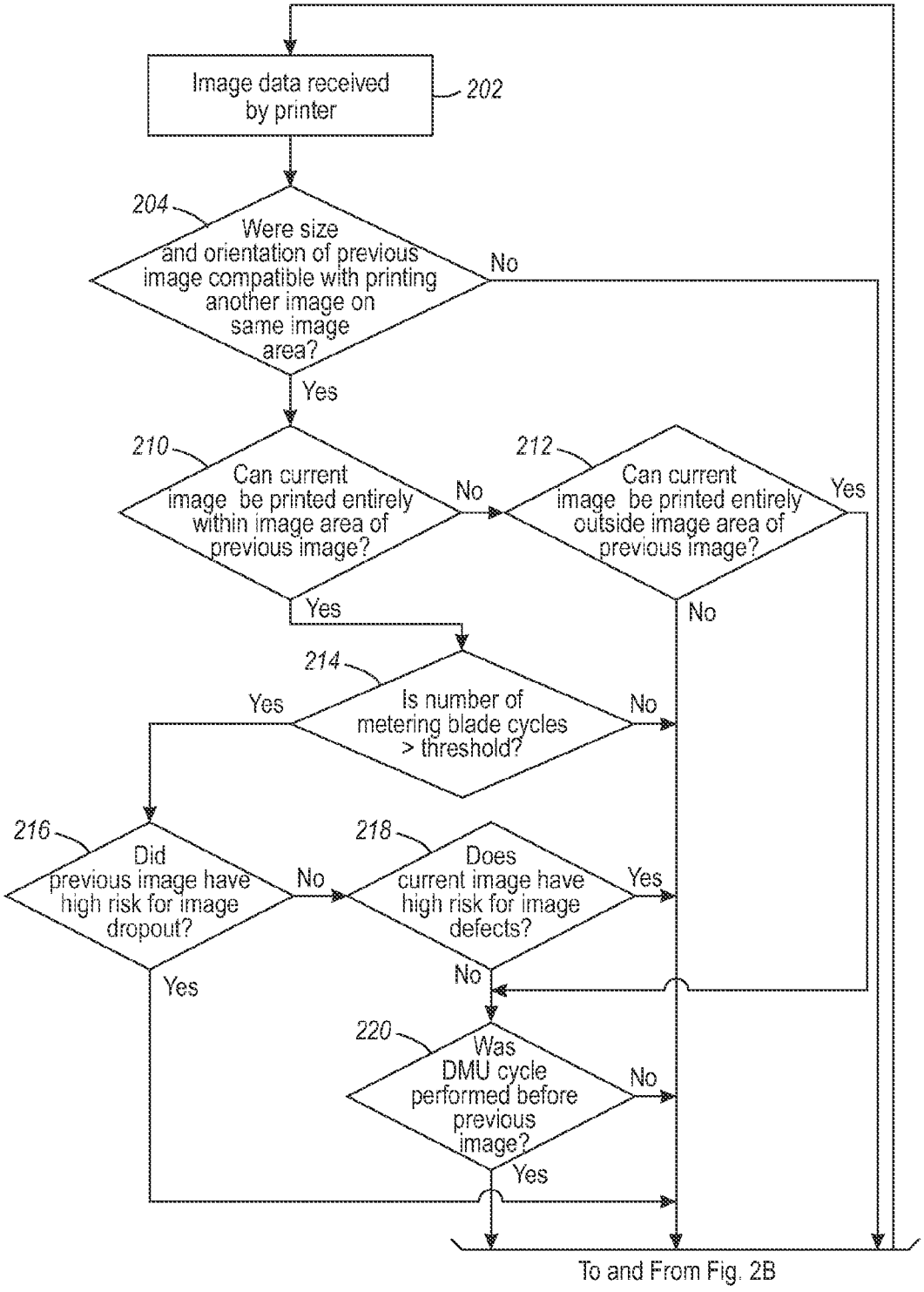
FIGS. 2A and 2B depict a flow diagram of a method that compares image characteristics to predetermined thresholds to determine whether to perform or skip a DMU cycle.
Figure 2B:
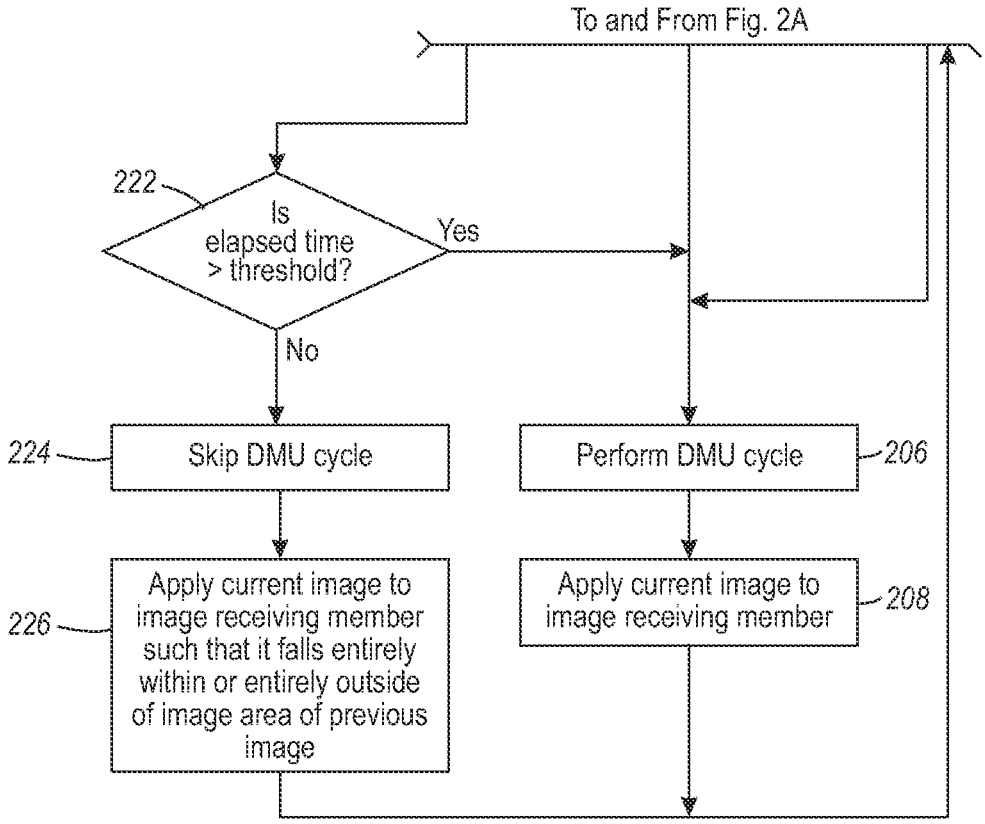

A method performed by the printer 10 that takes into account risk factors, such as print media size and orientation, the risk of image defects, and the amount of time elapsed since the last DMU cycle was performed when determining whether to perform or skip a DMU cycle is shown in FIGS. 2A and 2B. The method shown in FIGS. 2A and 2B can be applied to pluralities of ink images in the same manner as it is applied to individual ink images.

As shown, the image data for the image characteristics of a current image are received by the printer (block 202) and are then processed by the controller in the following manner. First, the controller identifies the size and orientation of the image area of the previous image (block 204) to determine whether another image can possibly be printed on the same image area without performing a DMU cycle. If the size and orientation of the image area of the previous image were not potentially compatible with skipping a DMU cycle, a DMU cycle is then performed (block 206), the current image is applied to the image receiving member (block 208), and the image data corresponding to the next image are received by the printer (block 202).

If the size and orientation of the image area of the previous image were potentially compatible with skipping a DMU cycle, the controller then determines whether the image area of the current image can be placed entirely within the image area of the previous image (block 210). If the image area of the current image cannot be placed entirely within the image area of the previous image, the controller then determines whether the image area of the current image can be placed entirely outside the image area of the previous image on the unused portion of release agent left on the image receiving member from the previous image (block 212). If the image area of the current image cannot be placed entirely outside the image area of the previous image, a DMU cycle is then performed (block 206), the current image is applied to the image receiving member (block 208), and the image data corresponding to the next image is received by the printer (block 202).

If the image area of the current image can be placed entirely within the image area of the previous image, then the controller compares a number of DMU cycles previously performed with the metering blade to a threshold number (block 214). If the number of DMU cycles is below the threshold number, a DMU cycle is then performed (block 206), the current image is applied to the image receiving member (block 208), and the image data corresponding to the next image are received by the printer (block 202). If the number of DMU cycles is above the threshold number, the controller then evaluates whether the image characteristics for the previous image had a high risk of image dropout (block 216). If the previous image did have a high risk of image dropout, a DMU cycle is then performed (block 206), the current image is applied to the image receiving member (block 208), and the image data corresponding to the next image is received by the printer (block 202). If the previous image did not have high risk of image dropout, the controller then evaluates whether the image characteristics for the current image have a high risk of ghosting or freckling (block 218). If the current image has a high risk of ghosting or freckling, a DMU cycle is then performed (block 206), the current image is applied to the image receiving member (block 208), and the image data corresponding to the next image is received by the printer (block 202).

If the current image does not have a high risk of ghosting or freckling, the controller then evaluates whether a DMU cycle was performed prior to the transfer of the previous image (block 220). Additionally, if the controller determines that the current image can be placed entirely outside the image area of the previous image (see block 212), the controller also then evaluates whether a DMU cycle was performed prior to the transfer of the previous image (block 220). If a DMU cycle was not performed prior to the transfer of the previous image, a DMU cycle is then performed (block 206), the current image is applied to the image receiving member (block 208), and the image data corresponding to the next image are received by the printer (block 202). If a DMU cycle was performed prior to the transfer of the previous image, the controller then evaluates how much time has elapsed since the last DMU cycle was performed and compares this to a threshold amount of time (block 222). If the amount of elapsed time is greater than the threshold, a DMU cycle is then performed (block 206), the current image is applied to the image receiving member (block 208), and the image data corresponding to the next image are received by the printer (block 202). If the amount of elapsed time is less than the threshold, the DMU cycle is skipped (block 224), the current image is applied to the image receiving member so that it falls entirely within or entirely outside of the image area of the previous image (block 226) and the image data corresponding to the next image are received by the printer (block 202).

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of operating a drum maintenance unit in a printer comprising:

transferring a first ink image formed on a layer of release agent on a surface of an image receiving member to a first media sheet and leaving a portion of the layer of release agent on the surface of the image receiving member;

forming a second ink image entirely on the portion of the layer of release agent on the surface of the image receiving member prior to additional release agent to the surface of the image receiving member; and transferring the second ink image from the image receiving member to a second media sheet.

2. The method of claim 1 further comprising:

identifying a number of isolated ink drops in the first ink image; and forming the second ink image entirely on the portion of the layer of release agent left on the surface of the image receiving member after the transfer of the first ink image in response to the identified number of isolated ink drops being below a predetermined threshold.

3. The method of claim 1 further comprising:

identifying a proportion of the layer of release agent that is covered by ink in the first ink image; and forming the second ink image entirely on the portion of the layer of release agent left on the surface of the image receiving member after the transfer of the first ink image in response to the identified proportion of the layer of release agent that is covered by ink in the first image being less than a predetermined threshold.

4. The method of claim 3 further comprising:

identifying a proportion of the portion of the layer of release agent left on the surface of the image receiving member after the transfer of the first ink image that will be covered by ink forming the second ink image prior to the second ink image being formed on the portion of the layer of release agent left on the surface of the image receiving member after the transfer of the first ink image; and forming the second ink image entirely on the portion of the layer of release agent left on the surface of the image receiving member after the transfer of the first ink image in response to the proportion of the portion of the layer of release agent left on the surface of the image receiving member after the transfer of the first ink image that will be covered by ink forming the second ink image being less than another predetermined threshold.

5. The method of claim 1 further comprising:

identifying a number of times that a metering blade engages the image receiving member to apply release agent to the image receiving member; and forming the second ink image entirely on the portion of the layer of release agent left on the surface of the image receiving member after the transfer of the first ink image in response to the identified number of times that the metering blade engages the image receiving member exceeding a predetermined threshold.

6. The method of claim 1 further comprising:

identifying a size of the first media sheet;

identifying a size of the second media sheet; and forming the second ink image entirely on the portion of the layer of release agent left on the surface of the image receiving member after the transfer of the first ink image in response to the second media sheet having a size that is less than or equal to the size of the first media sheet.

7. The method of claim 1 further comprising:

identifying a first time at which the first ink image is transferred to the first media sheet;

identifying a second time at which the second ink image will be formed on the portion of the layer of release agent left on the surface of the image receiving member; and forming the second ink image entirely on the portion of the layer of release agent left on the surface of the image receiving member after the transfer of the first ink image in response to an elapsed time between the identified first time and the identified second time being less than a predetermined threshold.

8. A method of operating a drum maintenance unit in a printer comprising:

forming a first plurality of ink images on a layer of release agent on a surface of an image receiving member;

transferring the first plurality of ink images formed on the surface of the image receiving member to a first plurality of media sheets and leaving a portion of the layer of release agent on the surface of the image receiving member;

forming a second plurality of ink images entirely on the portion of the layer of release agent left on the surface of the image receiving member after the transfer of the first plurality of ink images to the first plurality of media sheets and before additional release agent is applied to the image receiving member;

and transferring the second plurality of ink images from the surface of the image receiving member to a second plurality of media sheets.

9. The method of claim 8 further comprising:

identifying a number of isolated ink drops used to form the first plurality of ink images; and forming the second plurality of ink images in response to the identified number of isolated ink drops used to form the first plurality of ink images being below a predetermined threshold.

10. The method of claim 8 further comprising:

identifying a proportion of the layer of release agent on the surface of the image receiving member that is covered by ink used to form the first plurality of ink images; and forming the second plurality of ink images entirely on the portion of the layer of release agent left on the surface of the image receiving member after the transfer of the first plurality of ink images to the first plurality of media sheets in response to the identified proportion being less than a predetermined threshold.

11. The method of claim 10 further comprising:

identifying another proportion of the layer of release agent to be covered by ink that will form the second plurality of ink images, the other proportion being identified with reference to image data corresponding to the second plurality of ink images and the other proportion being identified prior to the second plurality of ink images being formed on the surface of the image receiving member; and forming the second plurality of ink images on the portion of the release agent left on the surface of the image receiving member in response to the identified other proportion being less than another predetermined threshold.

12. The method of claim 8 further comprising:

identifying a number of times that a metering blade engages the image receiving member to apply release agent to the image receiving member; and forming the second plurality of ink images on the portion of the release agent left on the surface of the image receiving member in response to the identified number of times that the metering blade engages the image receiving member exceeding a predetermined threshold.

13. The method of claim 8 further comprising:

identifying a first time at which the first plurality of ink images are transferred to the first plurality of media sheets;

identifying a second time at which the second plurality of ink images will be formed on the portion of the layer of release agent left on the surface of the image receiving member after the transfer of the first plurality of ink images to the first plurality of media sheets; and forming the second plurality of ink images on the portion of the layer of release agent left on the surface of the image receiving member after the transfer of the first plurality of ink images to the first plurality of media sheets in response to an elapsed time between the identified first time and the identified second time being less than a predetermined threshold.

14. A printer comprising:

an image receiving member configured to carry at least one ink image;

a maintenance unit configured to apply release agent to a surface of the image receiving member and form a layer of release agent on the surface of the image receiving member;

at least one printhead configured to eject ink drops onto the layer of release agent formed on the surface of the image receiving member to form the at least one ink image;

a media transport configured to engage a media sheet to the image receiving member to transfer an ink image from the image receiving member to the print medium; and a controller operatively connected to the image receiving member, the maintenance unit, the at least one printhead, and the media transport, the controller being further configured to:

form with the maintenance unit a first layer of release agent on the surface of the image receiving member;

form with the at least one printhead a first ink image on the layer of release agent on the surface of the image receiving member;

move with the media transport a first media sheet into engagement with the first ink image formed on the layer of release agent on the surface of the image receiving member to transfer the first ink image to the first media sheet and leaving a portion of the layer of release agent on the surface of the image receiving member;

form with the at least one printhead a second ink image on the portion of the layer of release agent left on the surface of the image receiving member prior to applying additional release agent to the surface of the image receiving member with the maintenance unit; and move with the media transport a second media sheet into engagement with the second ink image on the portion of the layer of release agent left on the surface of the image receiving member to transfer the second ink image to the second media sheet.

15. The printer of claim 14, the controller being further configured to:

identify a number of isolated ink drops in the first ink image; and form with the at least one printhead the second ink image entirely on the portion of the layer of release agent left on the surface of the image receiving member in response to the number of isolated ink drops being below a predetermined threshold.

16. The printer of claim 14, the controller being further configured to:

identify a proportion of the layer of release agent on the surface of the image receiving member that is covered by ink in the first ink image; and form with the at least one printhead the second ink image entirely on the portion of the layer of release agent left on the surface of the image receiving member in response to the identified proportion being less than a predetermined threshold.

17. The printer of claim 16, the controller being further configured to:

identify prior to forming the second ink image another proportion of the layer of release agent left on the surface of the image receiving member that will be covered by ink forming the second ink image, the other proportion being identified with reference to image data corresponding to the second ink image; and form with the at least one printhead the second ink image entirely on the portion of the layer of release agent layer left on the surface of the image receiving member in response to the other proportion being less than a second predetermined threshold.

18. The printer of claim 16, the maintenance unit further comprising:

a metering blade configured to engage the image receiving member to regulate a thickness of the release agent on the surface of the image receiving member; and the controller being further configured to:

identify a number of times that the metering blade engages the image receiving member; and form the second ink image entirely on the portion of the layer of release agent left on the surface of the image receiving member in response to the identified number of times that the metering blade engages the image receiving member exceeding a predetermined threshold.

19. The printer of claim 16, the controller being further configured to:

identify a size of the first media sheet;

identify a size of the second media sheet; and form with the at least one printhead the second ink image entirely on the portion of the layer of release agent left on the surface of the image receiving member in response to the second media sheet having a size that is less than or equal to the size of the first media sheet.

20. The printer of claim 16, the controller being further configured to:

identify a first time at which the first ink image is transferred to the first media sheet;

identify a second time at which the second ink image will be formed on the portion of the layer of release agent left on the surface of the image receiving member after the first ink image is transferred to the first media sheet; and form with the at least one printhead the second ink image entirely on the portion of the layer of release agent left on the surface of the image receiving member in response to an elapsed time between the identified first time and the identified second time being less than a predetermined threshold.

* * * * *